US010174597B2

(12) United States Patent
Looijer et al.

(10) Patent No.: US 10,174,597 B2
(45) Date of Patent: Jan. 8, 2019

(54) SUBSURFACE INJECTION OF REJECT STREAM

(71) Applicant: SHELL OIL COMPANY, Houston, TX (US)

(72) Inventors: Mark Theodoor Looijer, Rotterdam (NL); Gerbrand Jozef Maria Van Eijden, Rijswijk (NL); Bartholomeus Marinus Josephus Maria Suijkerbuijk, Utrecht (NL)

(73) Assignee: SHELL OIL COMPANY, Houston, TX (US)

( * ) Notice: Subject to any disclaimer, the term of this patent is extended or adjusted under 35 U.S.C. 154(b) by 373 days.

(21) Appl. No.: 14/977,138

(22) Filed: Dec. 21, 2015

(65) Prior Publication Data

US 2016/0177697 A1 Jun. 23, 2016

Related U.S. Application Data

(60) Provisional application No. 62/095,933, filed on Dec. 23, 2014.

(51) Int. Cl.
*E21B 33/124* (2006.01)
*E21B 43/20* (2006.01)

(52) U.S. Cl.
CPC ..... *E21B 43/20* (2013.01)

(58) Field of Classification Search
CPC ..... E21B 43/20; E21B 43/162
See application file for complete search history.

(56) References Cited

U.S. PATENT DOCUMENTS 3,467,191 A * 9/1969 Van Daalen ..... C09K 8/592 166/269
3,957,116 A * 5/1976 Bouck ..... C09K 8/60 166/245
4,715,444 A * 12/1987 MacAllister ..... E21B 43/20 166/269
4,834,178 A * 5/1989 Knecht ..... E21B 43/162 166/261
5,709,505 A * 1/1998 Williams ..... B09C 1/005 166/268
7,600,567 B2 * 10/2009 Christopher ..... B01D 61/025 166/263
8,469,092 B2 * 6/2013 Curole ..... B01D 61/027 166/272.3
9,234,413 B2 * 1/2016 Ayirala ..... E21B 43/20
9,464,516 B2 * 10/2016 Ayirala ..... E21B 43/20
9,657,216 B2 * 5/2017 Suijkerbuijk ..... C09K 8/588
9,885,228 B2 * 2/2018 Wolf ..... E21B 43/08
2003/0230535 A1 * 12/2003 Affeld ..... B01D 61/022 210/652

(Continued)

*Primary Examiner* — Benjamin F Fiorello

(57) ABSTRACT

Recovering oil from a subterranean formation is disclosed, comprising processing a source water to produce a processed water stream and a reject water stream; injecting a first fluid into an injection well toward a first downhole exhaust, wherein the first fluid comprises the processed water stream; and injecting a second fluid into the injection well toward a second downhole exhaust, wherein the second fluid comprises the reject water stream or a produced water stream, wherein the first fluid is separated from the second fluid within the injection well; and producing oil via a production well.

14 Claims, 5 Drawing Sheets

(56) References Cited

U.S. PATENT DOCUMENTS

| | | | | |
|---|---|---|---|---|
| 2009/0139932 | A1* | 6/2009 | Haas | B01D 61/022 210/652 |
| 2009/0211755 | A1* | 8/2009 | Dyer | E21B 43/14 166/252.1 |
| 2010/0243246 | A1* | 9/2010 | Ayirala | E21B 43/20 166/266 |
| 2012/0090833 | A1* | 4/2012 | Ligthelm | C09K 8/58 166/250.01 |
| 2012/0125604 | A1* | 5/2012 | Willingham | C09K 8/58 166/270.1 |
| 2012/0125605 | A1* | 5/2012 | Willingham | B01D 61/002 166/270.1 |
| 2012/0138304 | A1* | 6/2012 | Dykstra | E21B 34/08 166/316 |
| 2013/0168097 | A1* | 7/2013 | Janssen | E21B 43/20 166/305.1 |
| 2014/0041856 | A1* | 2/2014 | Janssen | E21B 43/20 166/90.1 |
| 2014/0042058 | A1* | 2/2014 | Janssen | C10G 53/04 208/188 |
| 2014/0196902 | A1* | 7/2014 | Southwick | C09K 8/588 166/300 |
| 2017/0205260 | A1* | 7/2017 | Jaaskelainen | G01F 1/66 |

* cited by examiner

SUBSURFACE INJECTION OF REJECT STREAM

This application claims the benefit of U.S. Provisional Application No. 62/095,933 filed Dec. 23, 2014, which is incorporated herein by reference.

FIELD OF THE INVENTION

The present invention is directed to methods for producing hydrocarbon-containing compositions from a subterranean formation and, more particularly, to recovering hydrocarbons using an aqueous recovery formulation.

BACKGROUND OF THE INVENTION

In the recovery of oil from a subterranean formation, primary recovery methods utilizing the natural formation pressure to produce the oil typically allow recovery of only a portion of the oil contained within the formation. Additional oil and hydrocarbon compounds from the formation may be produced by improved oil recovery (e.g. water injection) or enhanced oil recovery (EOR) methods.

Typically, water used in improved oil recovery and/or enhanced oil recovery production operations must be processed. Processing the source water generally includes filtering the water to remove solid particles and removing dissolved solids. Nanofiltration, Ultrafiltration, and/or Reverse Osmosis membranes can be used in this filtration process. The membrane filtration process usually generates a filtered water stream containing a reduced amount of dissolved solids, and often generates a rejection stream with a more concentrated amount of dissolved solids than the pre-filtered water.

The resulting rejection stream must be directed somewhere. In the case of oil production operations in the ocean, the rejection stream can usually be safely outlet back into the ocean. However, there are some seawater environments in which the rejection stream cannot be sent back to the source water environment, either for environmental, regulatory, or some other reason. In addition, injection operations occurring on land or where a natural sink for the rejection stream is not present, the rejection stream must typically be directed to a reject water storage, be further processed, and/or be hauled offsite from the production operation. It is desirable to find a way to use or dispose of the rejection water produced by water processing more efficiently.

BRIEF DESCRIPTION OF THE DRAWINGS

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION OF THE INVENTION

The present invention is directed to methods for producing hydrocarbon-containing compositions from a subterranean formation and, more particularly, to recovering hydrocarbons using an aqueous recovery formulation.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention.

Figure 1:
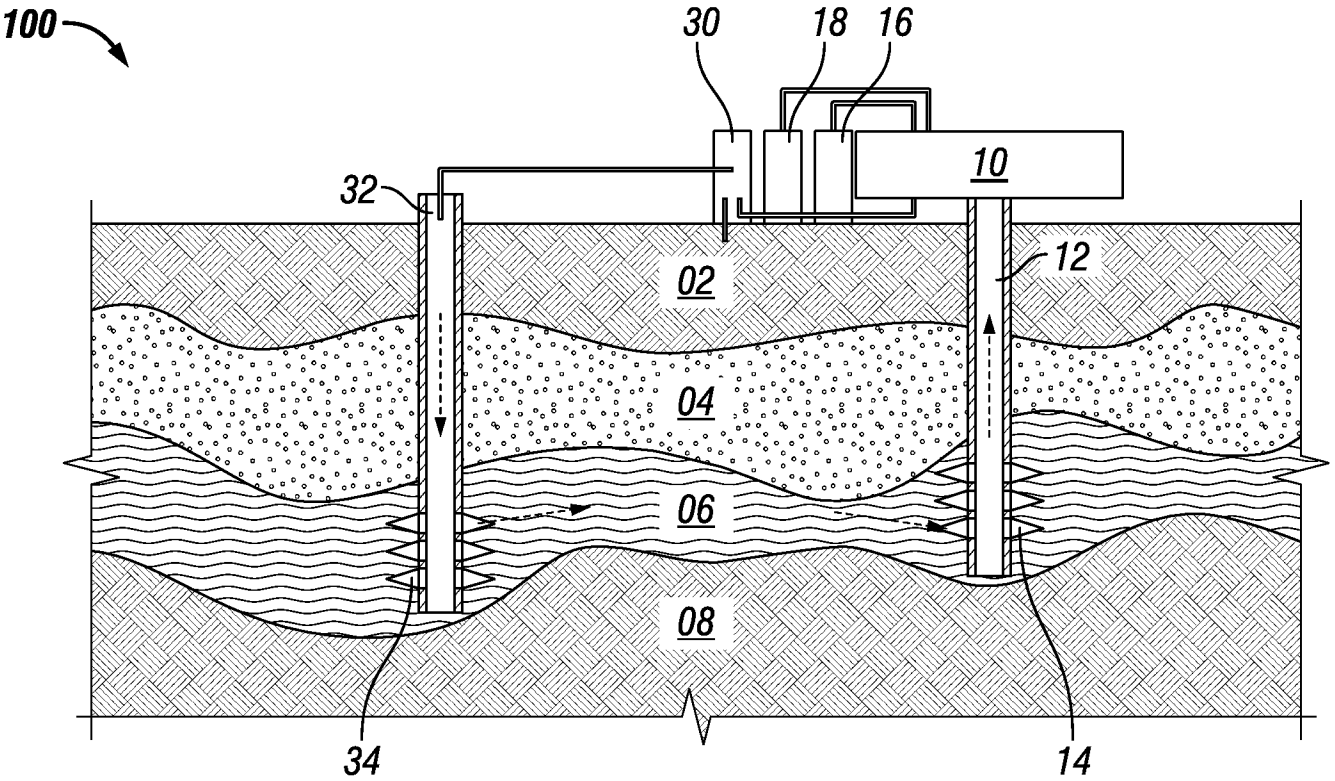
FIG. 1 shows an illustrative hydrocarbon production system, according to aspects of the present disclosure.

Referring now to FIG. 1, a system 100 for producing hydrocarbons from at least one subterranean formation 4, 6, 8 is illustrated. The system 100 may comprise a production well 12 traversing at least one formation 4 and comprising openings in formation 6 through which fluids may flow between the formation 6 and the production well 12. The system 100 may comprise an injection well 32 traversing at least one formation 4 and comprising openings in formation 6, through which fluids may flow between the formation 6 and the injection well 32. In certain embodiments, the production well 12 and/or the injection well may traverse a body of water 2. The formation 6 may comprise fractures and/or perforations 14, 34 proximate to the production well 12 and/or the injection well 32. The production well 12 may be connected to a production facility 10 located at the surface and structured and arranged to direct production fluids from the production well 12 toward the production facility 10. The production facility 10 may comprise a production fluid storage 16 and/or a gas storage 18.

In certain embodiments, the production facility 10 may comprise a water production facility 30. In certain embodiments, aqueous components of the production fluid received by the production facility 10 may be separated and sent to the water production facility 30. In certain embodiments, the production facility 10 may be able to process water, for example from the body of water 2 and/or the production well 12 to produce a processed water, which may be stored in the water production facility 30. The processed water may be pumped into an injection well 32 as an EOR flood toward formation 6, to aid in the flow of production fluids from the formation 6 into the production well 12. In certain embodiments, the EOR flood may be the processed water alone or a component of a chemical injection flood. In certain embodiments, water from the EOR flood flowing into the production well 12 may be recycled at the production facility 10, for example by returning water to water production facility 30, where it may be processed, then re-injected into the injection well 32.

In certain embodiments, the system 100 may comprise a plurality of injection wells 32. For example, in certain embodiments, the system 100 may comprise 2 to 100 injection wells. In certain embodiments, the system 100 may comprise a plurality of production wells 12. For example, in certain embodiments, the system 100 may comprise 2 to 100 production wells 12.

Figure 2B:
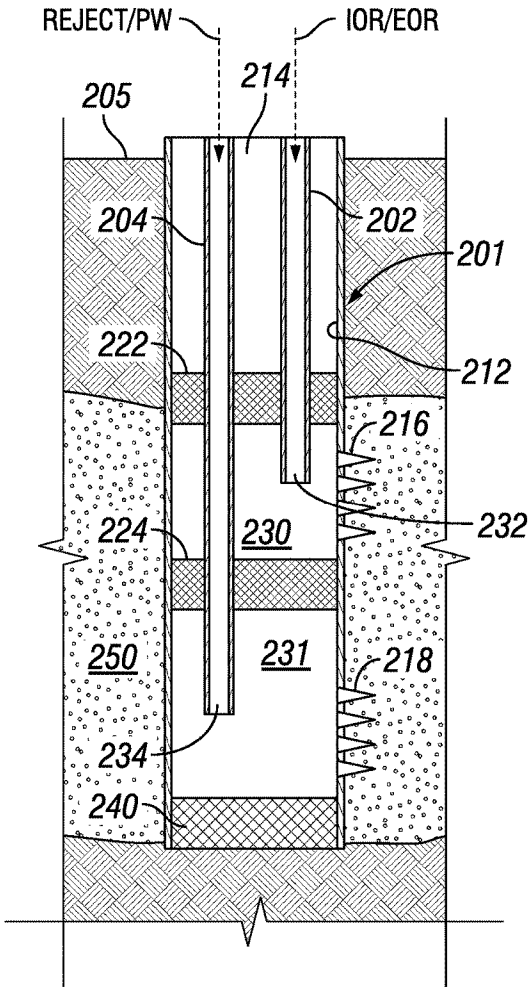
FIG. 2B shows an injection well system comprising a first conduit and a second conduit, according to aspects of the present disclosure.
Figure 2A:
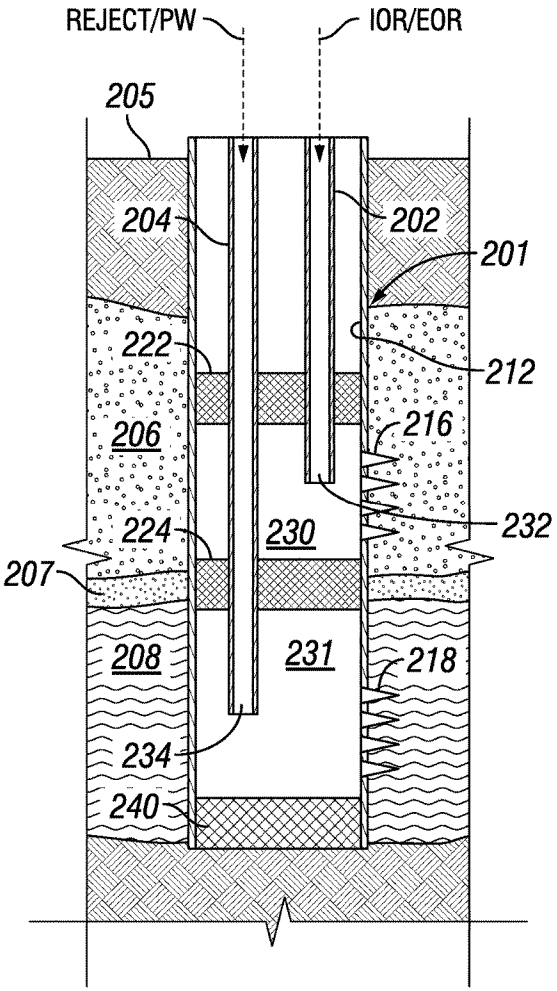
FIG. 2A shows an injection well system comprising a first conduit and a second conduit, according to aspects of the present disclosure.

Referring now to FIG. 2A, an example injection well 201 is shown extending into a first formation 206 and a second formation 208 and comprising a first opening 216 within the first formation 206 and a second opening 218 within the second formation 208. The injection well 201 may comprise an injection well inner wall 212 and a cavity 214 disposed within the injection well 201 and defined by the injection well inner wall 212. In certain embodiments, the injection well 201 may extend from a surface 205 into at least a first formation 206 and a second formation 208.

The injection well 201 may comprise a first spacer 222 disposed within the injection well cavity 214 and engaging the injection well inner wall 212. The injection well 201 may comprise a second spacer 224 disposed within the injection well cavity 214 and engaging the injection well inner wall 212. In certain embodiments, the second spacer 224 may be downhole from the first spacer 222.

A first injection zone 230 may be defined between the first spacer 222 and the second spacer 224, within the injection well cavity 214. In certain embodiments, a second injection zone 231 may be defined downhole of the second spacer 224 within the injection well cavity 214. In certain embodiments, the second spacer 224 may substantially prevent fluid flow between the first and second injection zones 230, 231. In certain embodiments, the second injection zone 231 may extend to a downhole end 240 of the injection well 201. In certain embodiments, the second injection zone 231 may extend to a third spacer located within the injection well cavity 214.

In certain embodiments, a formation permeability barrier 207 may be disposed between the first formation 206 and the second formation 208. The formation permeability barrier 207 may have a lower permeability to oil and/or water than the first formation 206 and the second formation 208. As a result, flow of oil and/or water between the first formation 206 and the second formation 208 may be restricted. In certain embodiments, the formation permeability barrier 207 may define the lower bounds of the first formation 206 and the upper bounds of the second formation 208. In certain embodiments, the first spacer 222 and/or the second spacer 224 may be located adjacent to a formation permeability barrier 207.

The injection well 201 may comprise a first opening 216 within the first injection zone 230 and a second opening 218 within the second injection zone 231. The first opening 216 may fluidly connect the first injection zone 230 with the first formation 206, allowing fluid flow between the first injection zone 230 and the first formation 206. The second opening 218 may fluidly connect the second injection zone 231 with the second formation 208, allowing fluid flow between the second injection zone 231 and the second formation 208.

In certain embodiments, the injection well 201 may comprise a first conduit 202 disposed within the cavity 214 and a second conduit 204 disposed within the cavity 214. The first conduit 202 and the second conduit 204 may extend from the surface 205 into the injection well 201.

In certain embodiments, the first conduit 202 may extend through the first spacer 222 and fluidly connect the surface 205 to the first injection zone 230. The first conduit 202 may comprise a first downhole exhaust 232 within the first injection zone 230.

In certain embodiments, the second conduit 204 may extend within the cavity through the first spacer 222 and the second spacer 224 and comprise a second downhole exhaust 234 within the second injection zone 231.

In certain embodiments, a first fluid pumped into the first conduit 202 may be directed into the first injection zone 230 and into the first formation 206. A second fluid pumped into the second conduit 204 may be directed into the second injection zone 231 and into the second formation 208. The first fluid and the second fluid may be substantially separated within the injection well 201 by the first and second conduits 202, 204 and/or the first and second spacers 222, 224.

The first fluid may be one of an oil recovery fluid, an enhanced oil recovery fluid, a processed water, a reject water, a produced water, or a combination sink water. The second fluid may be one of an oil recovery fluid, an enhanced oil recovery fluid, a processed water, a reject water, a produced water, or a combination sink water. Processing a source water may generate a processed water stream and a reject water stream. Produced water may be obtained from the production well along with other formation fluids such as oil and/or gas. Oil recovery fluid and enhanced oil recovery fluid may comprise processed water.

The first fluid and the second fluid may be any combination of these fluids. For example, in certain embodiments, the first fluid may be an oil recovery fluid and the second fluid may be the reject water. For example, the first fluid may be the reject water and the second fluid may be the produced water. For example, the first fluid may be an enhanced oil recovery fluid and the second fluid may be the produced water. Although several examples of these combinations are provided, the present disclosure does not intend to be limited to these combinations and contemplates injecting any combination of fluids into the first conduit and the second conduit.

FIG. 2B shows an example injection well 201 as described in FIG. 2A, extending into a unified formation 250 and comprising a first opening 216 and second opening 218 within the unified formation 250, where the first opening 216 is uphole from the second opening 218. The first conduit 202 may direct fluid into the first injection zone 230 and into an upper area of the unified formation 250 through the first opening 216. The second conduit 204 may direct fluid into the second injection zone 231 and into a lower area of the unified formation 250, through the second opening 218. The second fluid injected into the lower area of the unified formation 250 may aid oil recovery from the unified formation 250. For example, where the first fluid is an enhanced oil recovery fluid and the second fluid is a reject fluid, the reject fluid may drive oil and/or gas within the unified formation 250 upward, toward the enhanced oil recovery fluid in the upper area of the unified formation 250.

Figure 2C:
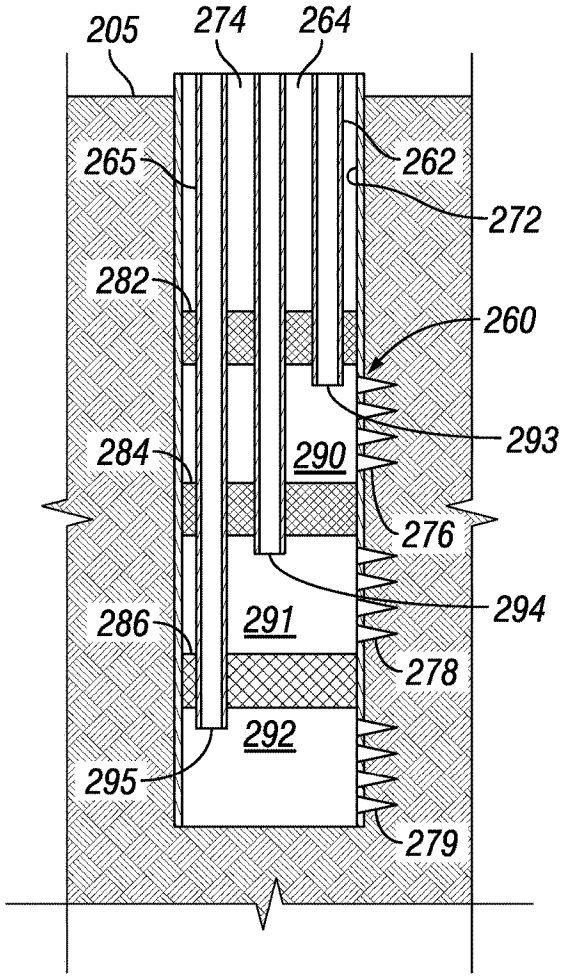
FIG. 2C shows an injection well system comprising a first conduit, a second conduit, and a third conduit, according to aspects of the present disclosure.

Referring now to FIG. 2C, an injection well 260 is shown comprising a third conduit 265. The injection well 201 may comprise an injection well inner wall 272 and a cavity 274 disposed within the injection well 260 and defined by the injection well outer wall 272.

In certain embodiments, the injection well 260 may comprise a first spacer 282 disposed within the injection well cavity 274 and engaging the injection well inner wall 272, a second spacer 284 disposed within the injection well cavity 274 and engaging the injection well inner wall 272, and a third spacer 286 disposed within the injection well cavity 274 and engaging the injection well inner wall 272. In certain embodiments, the second spacer 284 may be downhole from the first spacer 282 and the third spacer 286 may be downhole from the first spacer 282 and the second spacer 284.

A first injection zone 290 may be defined between the first spacer 282 and the second spacer 284, within the injection well cavity 274. In certain embodiments, a second injection zone 291 may be defined downhole of the second spacer 284 within the injection well cavity 274. In certain embodiments, a third injection zone 292 may be defined downhole of the third spacer 286 within the injection well cavity 274. In certain embodiments, the second spacer 284 may substantially prevent fluid flow between the first and second injection zones 290, 291. In certain embodiments, the third spacer 286 may substantially prevent fluid flow between the second and third injection zones 291, 292.

The injection well 260 may comprise a first opening 276 within a first injection zone 290, a second opening 278 within a second injection zone 291, and a third opening 279 within a third injection zone 292. The first opening 276 may fluidly connect the first injection zone 290 with a first formation. The second opening 278 may fluidly connect the second injection zone 291 with a second formation. The third opening 279 may fluidly connect the third injection zone 292 with a third formation.

In certain embodiments, the injection well 260 may comprise a first conduit 262 disposed within the cavity 274, a second conduit 264 disposed within the cavity 274, and a third conduit 265 disposed within the cavity 274. The first conduit 262, the second conduit 264, and the third conduit 265 may extend from the surface 205 into the injection well 260. In certain embodiments, the first conduit 262 may extend through the first spacer 282 and fluidly connect the surface 205 to the first injection zone 290. The first conduit 262 may comprise a first downhole exhaust 293 within the first injection zone 290. In certain embodiments, the second conduit 264 may extend through the first spacer 282 and the second spacer 284 and fluidly connect the surface 205 to the second injection zone 291. The second conduit 264 may comprise a second downhole exhaust 294 within the second injection zone 291. In certain embodiments, the third conduit 265 may extend through the first spacer 282, the second spacer 284, and the third spacer 286 and fluidly connect the surface 205 to the third injection zone 292. The third conduit 265 may comprise a third downhole exhaust 295 within the second injection zone 292.

In certain embodiments, a first fluid pumped into the first conduit 262 may be directed into the first injection zone 290 and through the first opening 276. A second fluid pumped into the second conduit 264 may be directed into the second injection zone 291 and through the second opening 278. A third fluid pumped into the third conduit 265 may be directed into the third injection zone 292 and through the third opening 279. The first fluid, the second fluid, and the third fluid may be substantially separated within the injection well 260.

Figure 3A:
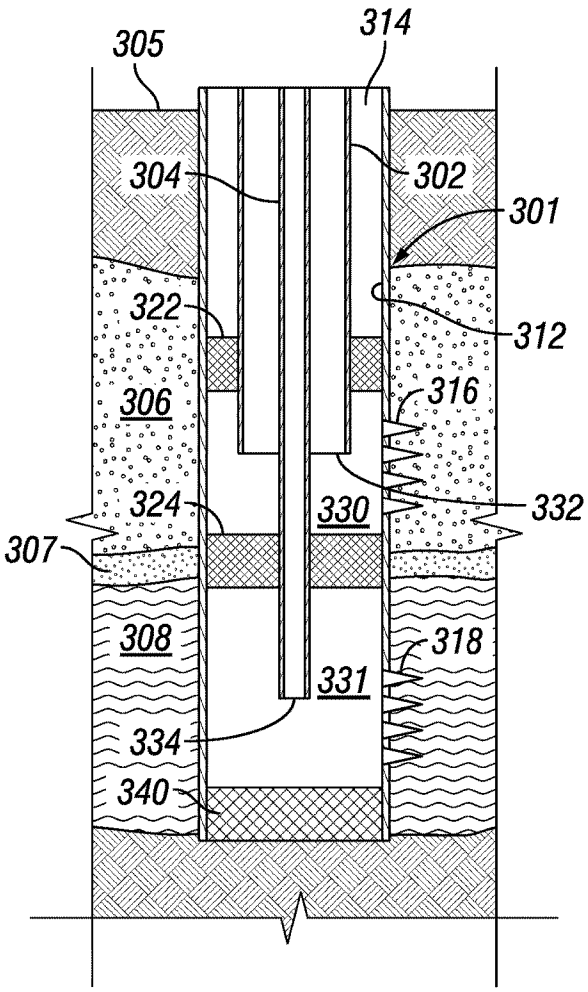
FIG. 3A shows an injection well system comprising a first conduit and a second conduit concentric with the first conduit, according to aspects of the present disclosure.
Figures 3B, 4:
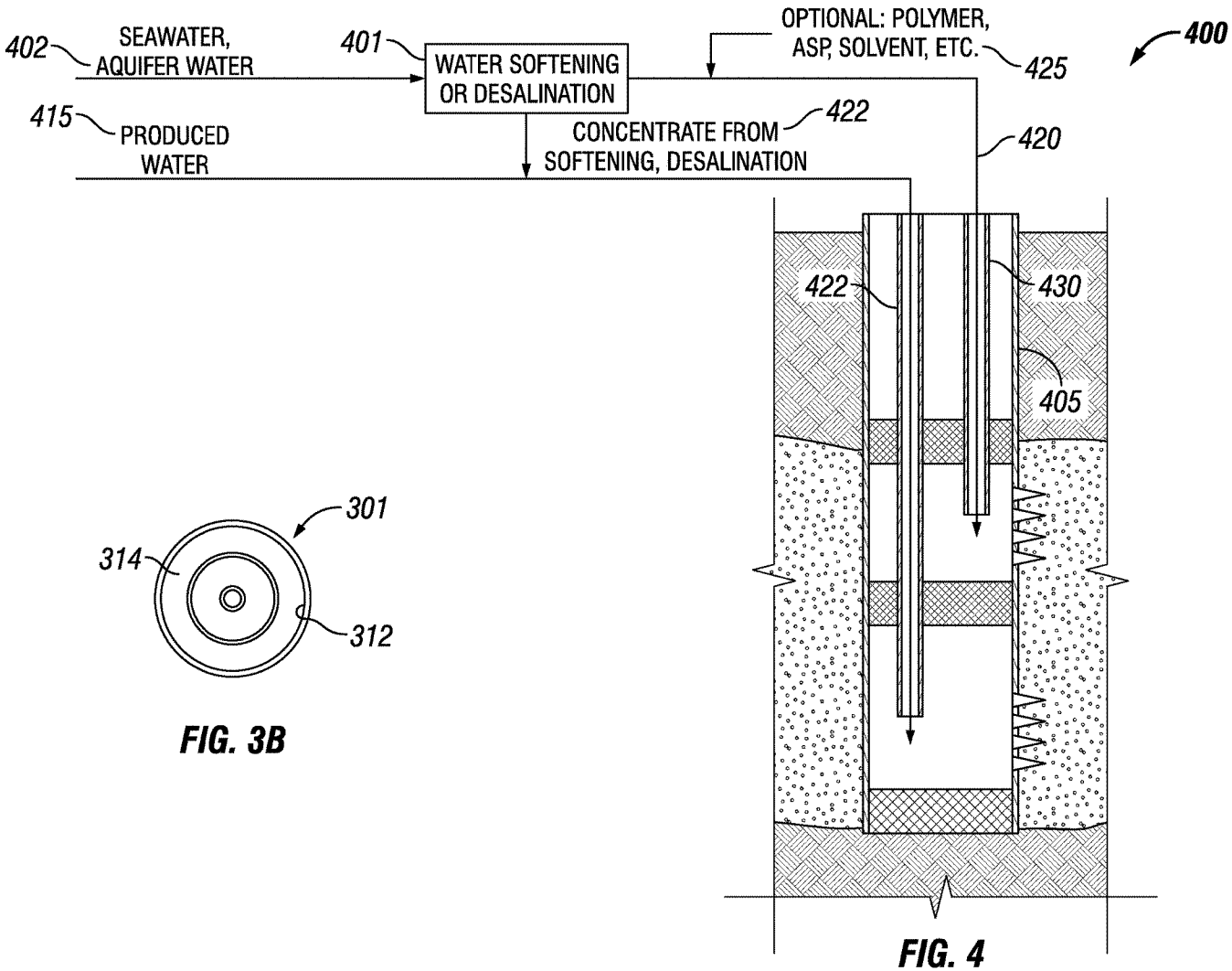
FIG. 3B shows a top-view of an injection well system comprising a first conduit and a second conduit concentric with the first conduit, according to aspects of the present disclosure.
FIG. 4 illustrates a water processing system, according to aspects of the present disclosure.

Referring now to FIGS. 3A and 3B, FIG. 3A shows an example injection well 301 extending into a first formation 306 and a second formation 308, and FIG. 3B is a top-view of the injection well 301, according to certain embodiments. The injection well 301 may comprise a first conduit 302 and a second conduit 304 within the first conduit 302 and concentric to the first conduit 302. The injection well 301 may comprise an injection well inner wall 312 and a cavity 314 disposed within the injection well 301 and defined in the annulus between the second conduit 302 and the injection well outer wall 312. In certain embodiments, the injection well 301 may extend from a surface 305 into at least a first formation 306 and a second formation 308.

The injection well 301 may comprise a first spacer 322 disposed in an annulus between the first conduit 302 and the second conduit 304. The injection well 301 may comprise a second spacer 324 disposed within the injection well cavity 314 and between the injection well inner wall 312 and the second conduit 304. In certain embodiments, the second spacer 324 may be downhole from the first spacer 322.

A first injection zone 330 may be defined within the injection well cavity 314 above the second spacer 324, for example, between the first spacer 322 and the second spacer 324. In certain embodiments, a second injection zone 331 may be defined downhole of the second spacer 324 within the injection well cavity 314. In certain embodiments, the second spacer 324 may substantially prevent fluid flow between the first and second injection zones 330, 331. In certain embodiments, the second injection zone 331 may extend to a downhole end 340 of the injection well 301.

In certain embodiments, a formation permeability barrier 307 may be disposed between the first formation 306 and the second formation 308. The formation permeability barrier 307 may have a lower permeability to oil and/or water than the first formation 206 and the second formation 308. As a result, flow of oil and/or water between the first formation 306 and the second formation 308 may be restricted. In certain embodiments, the formation permeability barrier 307 may define the lower bounds of the first formation 306 and the upper bounds of the second formation 308. In certain embodiments, the first spacer 322 and/or the second spacer 324 may be located adjacent to a formation permeability barrier 307.

The injection well 301 may comprise a first opening 316 within the first injection zone 330 and a second opening 318 within the second injection zone 231. The first opening 316 may fluidly connect the first injection zone 330 with the first formation 306, allowing fluid flow between the first injection zone 330 and the first formation 306. The second opening 318 may fluidly connect the second injection zone 331 with the second formation 308, allowing fluid flow between the second injection zone 331 and the second formation 308.

In certain embodiments, the first conduit 302 may extend through the first spacer 322 and fluidly connect the surface 305 to the first injection zone 330. The first conduit 302 may comprise a first downhole exhaust 332 within the first injection zone 330.

In certain embodiments, the second conduit 304 may extend within the cavity through the second spacer 324 and comprise a second downhole exhaust 334 within the second injection zone 331.

The first conduit 302 may direct a first fluid into the first injection zone 330, where the first fluid may flow into the first formation 306 through the first openings 316. The second conduit 304 may direct a second fluid into the second injection zone 331, where the second fluid may flow into the second formation 308 through second openings 318. The first fluid and the second fluid may be substantially separated within the injection well 301 by the first and second conduits 302, 304 and/or the first and second spacers 322, 324.

In certain embodiments, the first fluid may be an EOR fluid and the second fluid may be a reject water. For example, the reject water may be produced from processing the water using a reverse osmosis device, as will be discussed herein. In certain embodiments, the first fluid may be the reject water and the second fluid may be the EOR fluid.

Referring now to FIG. 4, an injection system 400 is shown comprising a water processing system 401. The water processing system 401 processes a source water 402 and generates a processed water 420 and a reject water 422. In certain embodiments, the processed water 420 may be injected into an injection well 405 via a first conduit 430. In certain embodiments, an alkaline component, a polymer, a surfactant, and/or other chemical component may optionally be added to the processed water at 425 to generate an enhanced oil recovery (EOR) fluid.

In certain embodiments, the reject water 422 may be injected into the injection well 405 via a second conduit 422. In certain embodiments, the reject water 422 may be combined with a produced water 415 before injection into the injection well 405. In certain embodiments, the produced water 415 may be injected alone into the injection well 405 via the second conduit 422. Although not shown in FIG. 4, in certain embodiments, the produced water may be injected into the injection well via the first conduit 430.

Figure 5:
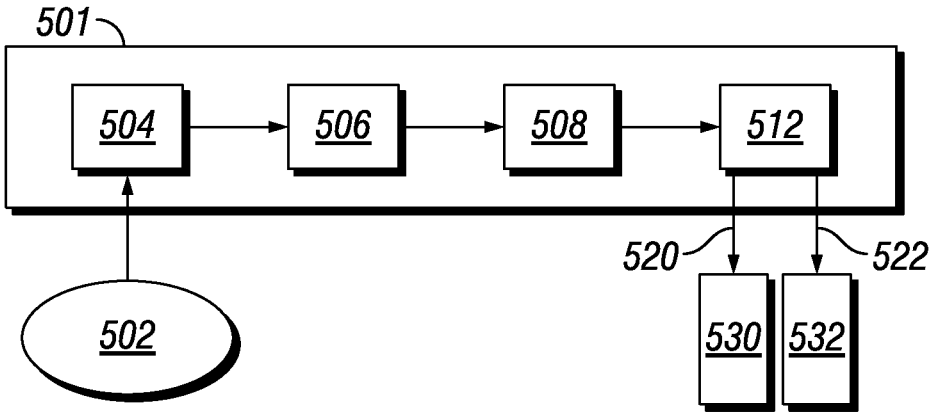
FIG. 5 illustrates a water filtration process, according to aspects of the present disclosure.

Referring now to FIG. 5, a water processing system 501 is illustrated, according to aspects of the present disclosure. The water processing system 501 may comprise obtaining a source water 502. The source water may comprise seawater, fresh water, brine, well water, produced water, connate water, or water from any other water supply. The source water 502 may be pre-filtered at step 504, which may include removing large particles and/or suspended material from the source water. For example, a large particle strainer may be used at step 504 to pre-filter the source water.

At step 506, in certain embodiments, some dissolved solids may be removed from the source water. For example, in certain embodiments, a nanofiltration device and/or an ultrafiltration device may remove some dissolved solids from the source water. In certain embodiments, step 506 may comprise removing some divalent cations from the source water. For example, in certain embodiments, at step 506, 60% to 99% of the divalent cations present in the source water may be removed.

At step 508, the source water may be deaerated to remove some air from the source water. In certain embodiments, deaeration may come before removing dissolved solids from the source water. In certain embodiments, deaeration of the source water may occur at any point prior to pumping the water downhole.

At step 512, the source water may be filtered using a filtration device to produce a processed water stream 520 and a reject water stream 522. For example, in certain embodiments, the filtration device may comprise a nanofiltration (NR) device and/or a reverse osmosis (RO) device. In certain embodiments, the filtration device may produce the processed water stream 520 and the reject water stream 522 in substantially equal volumes. For example, filtering a source water comprising seawater using an RO device may produce a processed water stream 520 and a reject water stream 522 in a ratio of substantially 1:1 (i.e., with substantially equal volumes). In certain embodiments, the filtration device may produce the processed water stream 520 and the reject water stream 522 in different volumes. For example, filtering a source water comprising sea water using an NF device may produce a processed water stream 520 and a reject water stream 522 in a respective ratio of 3:1 (i.e., about 0.75 L of processed water may be produced for every 0.25 L of reject water). In certain embodiments, the ratio of processed water to reject water produced by the filtration device may depend on the total dissolved solid (TDS) concentration of the source water, for example lower TDS concentration may lower the volume of reject water produced for each volume of source water filtered. The reject water stream 522 may have a higher TDS concentration than the processed water stream 520. In certain embodiments, the reject water stream 522 may have a higher TDS concentration than the source water input into the filtration device at step 512.

Optionally, the processed water stream 520 may be combined with at least one chemical component to produce a chemical flood. The processed water stream 520 and/or the chemical flood comprising the processed water stream may be directed into an EOR flood conduit 530. The EOR flood may be pumped into a target formation from which hydrocarbons are produced. In certain embodiments, the EOR flood conduit 530 may comprise the first conduit and/or the second conduit as discussed in connection to FIGS. 2A-2C. In certain embodiments, the EOR flood conduit 530 may comprise the first conduit and/or the second conduit as discussed in connection to FIGS. 3A and 3B. As such, the processed water stream 520 may be pumped through an injection well via the first conduit or the second conduit and into a first formation or a second formation.

The reject water stream 522 may be directed into a reject water conduit 532. In certain embodiments, the reject water conduit 532 may comprise the first conduit and/or the second conduit as discussed in connection to FIGS. 2A-2C. In certain embodiments, the reject water conduit 532 may comprise the first conduit and/or the second conduit as discussed in connection to FIGS. 3A and 3B. As such, the reject water stream 522 may be pumped through an injection well via the first conduit or the second conduit and into a first formation or a second formation.

In certain embodiments, the reject water stream 522 may be pumped into the second formation below the target formation for production. Injection of reject water into the second formation may aid in recovery of oil from the first formation through creation of a density gradient (i.e., between water in the lower formation layer and less dense oil in the upper formation layer). The reject water stream 522 may also aid in production of oil from the second formation by pushing and/or mobilizing hydrocarbons toward the production well.

The present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. While systems, methods, and compositions are described in terms of "comprising," "containing," or "including" various components or steps, the systems, methods, and compositions can also "consist essentially of" or "consist of" the various components and steps.

Whenever a numerical range with a lower limit and an upper limit is disclosed, any number and any included range falling within the range is specifically disclosed. In particular, every range of values (of the form, "from a to b," or, equivalently, "from a-b") disclosed herein is to be understood to set forth every number and range encompassed within the broader range of values. Whenever a numerical range having a specific lower limit only, a specific upper limit only, or a specific upper limit and a specific lower limit is disclosed, the range also includes any numerical value "about" the specified lower limit and/or the specified upper limit. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces.

What is claimed is:

1. A method for recovering oil from a subterranean formation, comprising:

processing a source water to produce a processed water stream and a reject water stream;

injecting a first fluid into an injection well toward a first downhole exhaust, wherein the first fluid comprises the processed water stream; and injecting a second fluid into the injection well toward a second downhole exhaust, wherein the second fluid comprises the reject water stream, wherein the first fluid is separated from the second fluid within the injection well and wherein the first fluid and the second fluid each are injected into a formation layer; and producing oil from the formation via a production well.

2. The method of claim 1, further comprising injecting a third fluid into the injection well toward a third outlet point, wherein the third fluid is separated from the first fluid and second fluid within the injection well.

3. The method of claim 1, wherein the first fluid comprises an oil recovery fluid.

4. The method of claim 1, wherein the first fluid comprises an enhanced oil recovery fluid.

5. The method of claim 1, wherein the first fluid and the second fluid are injected into the same formation layer.

6. The method of claim 1, wherein the first fluid is injected into a first formation layer and the second fluid is injected into a second formation layer.

7. The method of claim 6, wherein the second formation layer is below the first formation layer.

8. The method of claim 1, wherein the source water comprises a seawater, aquifer, fresh water, brine, ocean water, surface water, river water, pond water, produced water, treated produced water, or municipal water.

9. The method of claim 1, wherein processing the source water produces substantially equal amounts of the processed water stream and the reject water stream.

10. A system for recovering oil from a subterranean formation, comprising:

an injection well extending into at least one formation layer;

a spacer disposed within the injection well and separating a first injection zone disposed within the injection well and a second injection zone disposed within the injection well;

a first conduit disposed within the injection well and a second conduit disposed within the injection well, wherein the first conduit comprises a first fluid exhaust in fluid communication with the first injection zone and wherein the second conduit comprises a second fluid exhaust in fluid communication with the second injection zone;

a filtration device structured and arranged to direct a processed water toward the first conduit and direct a reject water toward the second conduit; and a production well in fluid communication with the at least one formation layer.

11. The system of claim 10, further comprising a produced water conduit structured and arranged to direct produced water toward the first conduit or the second conduit.

12. The system of claim 10, further comprising a third conduit disposed within the injection well comprising a third fluid exhaust in fluid communication with a third injection zone, wherein the third injection zone is downhole of the second injection zone.

13. The system of claim 12, further comprising a second spacer disposed within the injection well separating the second injection zone from a third injection zone.

14. The system of claim 10, wherein the second injection zone is downhole from the first injection zone.

* * * * *